United States Patent [19]

McClees et al.

[11] Patent Number: 4,879,768

[45] Date of Patent: Nov. 14, 1989

[54] NON-SLIP STRAP PAD

[75] Inventors: David L. McClees, Lewiston, Me.; John S. McClees, Jr., Towson, Md.; Michael P. McConnell, Durham, N.H.

[73] Assignee: Talus Corp., Lewiston, Me.

[21] Appl. No.: 190,132

[22] Filed: May 4, 1988

[51] Int. Cl.[4] ..... A41D 27/26

[52] U.S. Cl. ..... 2/268; 2/2

[58] Field of Search ..... 2/267, 268

[56] References Cited

U.S. PATENT DOCUMENTS

| | | | |
|---|---|---|---|
| 978,620 | 12/1910 | Murk | 2/268 |
| 2,304,699 | 12/1942 | Levy | 2/268 |
| 2,416,415 | 2/1947 | Stehlik | 2/268 |
| 2,497,387 | 2/1950 | Weber | 2/268 |
| 2,509,645 | 5/1950 | Kleinrock | 2/268 |
| 2,640,993 | 6/1958 | Kleinman | 2/268 |
| 2,858,545 | 11/1958 | Silverman | 2/268 |
| 3,050,734 | 8/1962 | Dopyera | 2/268 |
| 3,052,886 | 9/1962 | White | 2/268 |
| 4,493,115 | 1/1985 | Maier et al. | 2/268 X |
| 4,642,815 | 2/1987 | Allen | 2/267 X |

OTHER PUBLICATIONS

Maurice Gershman, "Self Adhering Nylon Tapes", *The Journal of the AMA,* p. 930, vol. 168, No. 7, dated Oct. 19, 1958.

*Primary Examiner*—Werner H. Schroeder

*Assistant Examiner*—Jeanette E. Chapman

*Attorney, Agent, or Firm*—Mosely, Neal J.

[57] ABSTRACT

A shoulder strap pad is disclosed which is superior to prior pads or coverings because it takes advantage of the anatomical and biomechanical characteristics of the user's shoulder to provide anatomically correct support for carrying straps. This strap pad fits the shape of the shoulder, effectively raising the shoulder's profile so that there is no slope down which the strap may slide. This is accomplished by shaping the cushioning pad into a wedge or triangular shape. The strap is carried on top of this wedge and pushes down but cannot slide out. Prior pads and cushions have limited themselves to increasing the friction between strap and shoulder (or garment thereon). This frictional approach may also be used in combination with the instant invention to further prevent slipping. By making the wedge out of a cushion (whether of resilient synthetic or natural foam or of a filled cushion-like material), the carrying burden is further reduced. The wedge is positioned below the strap and increases the slope of the shoulder to level or to a slight incline. The pad may be bare, or it may be covered by leather, textile, or other fabric to make it more comely or to assist in attaching it to a strap. It may be formed separately as an attachment to any strap with suitable means for attachment, including but not limited to Velcro-like hook and loop fastening, adhesive, loops, or snaps. It may also be an integral part of such a carrying strap.

18 Claims, 2 Drawing Sheets

NON-SLIP STRAP PAD

FIELD OF THE INVENTION

This invention relates to pads for shoulder carrying straps and more particularly to a non-slip strap pad for cushioning a carrying strap and preventing it from slipping off the user's shoulder.

BACKGROUND OF THE INVENTION

When one is carrying an object by means of a strap or straps over the shoulder, the carried object frequently jostles, causing the strap to slip in increments and to fall or threaten to slide off the shoulder. This is particularly so for women and those individuals not having broad perpendicular shoulders. Furthermore, because of the weight of such carried objects, the strap frequently cuts into the shoulder, and also causes soreness from holding the shoulder in such a way that the strap does not slide. Carried objects frequently include luggage, handbags, purses, backpacks, skis, golfbags, musical instruments, and computers; however this invention concerns the straps, and an attachment to such straps, used to carry these and other objects.

To alleviate these problems, covers have been used to reduce the chafing of these usually abrasive straps. High friction attachments (such as suede or raw leather) have also been used in an effort to prevent the carried object from slipping. Some individuals have added flat pads with a high friction covering in an attempt to preclude this abrasion, slipping and all of the resultant problems.

BRIEF DESCRIPTION OF THE PRIOR ART

Because of the unsatisfactory nature of the current covers, pads, and high-friction attachments for this purpose, considerable energy has been expended to develop a pad to cushion the user's shoulder while at the same time preventing or substantially reducing the slippage of the carried bag.

As described above, most prior pads are a flat shape, thereby cushioning the carried bag, but not solving the slipping problem with all its resultant discomforts. The high friction coverings seek to prevent the slipping problem, however with limited success, and they in no way address the need to cushion the strap.

Most prior strap coverings relate to covering safety harnesses and seat belts. While all of these are directed to increasing the wearer's comfort, they take the approach of incorporating a flat foam pad or stuffing so as to merely cushion the seat belt, or of merely covering the belt with a softer and less abrasive material.

Such inventions are disclosed in Wold U.S. Pat. No. 4,678,205 and LaPointe U.S. Pat. No. 4,693,495, and in Roberts U.K. Pat. No. 1,581,996 and G & K Dilley, Ltd. U.K. Pat. No. 2,048,651. These patents also refer to whether the attachment may slide on the seat belt or safety harness. Finnigan U.S. Pat. No. 3,957,282 is similar, but claims also for a foam cushion covering the patent such that it will widen when pressed against the wearer's neck. Other pads for straps are shown in Fein U.S. Pat. No. 3,397,913 for a seat belt cover, Mule U.S. Pat. No. 4,386,723 for a firearm sling keeper, and Ocel U.S. Pat. No. 4,177,807 for a padded belt for wheelchairs and stretchers.

Thus all of the prior pads (1) relate to covering a seat belt or safety harness, and (2) have the object either of reducing the abrasiveness of said belt or of cushioning said belt. Thus, to date, there is no known prior art showing a pad that structurally assists the carrier in keeping carrying straps comfortably positioned on the shoulder.

SUMMARY OF THE INVENTION

Accordingly, it is an object of the present invention to provide an improved shoulder strap pad.

Another object of the invention is to provide a shoulder strap pad which by its structure prevents or retards the strap from slipping off the shoulder, thereby preventing the strain and soreness resulting from moving or holding the shoulder in such as way as to accomplish this without the strap pad.

A further object of the invention is to provide a strap pad which cushions the strap when worn on the shoulder, thereby minimizing strain and abrasion on the shoulder.

Still another object of the invention is to provide a strap pad which is relatively compact and comely so that it can be carried conveniently and is not unsightly when used in public.

Yet another object of the invention is to provide a cushion of this type which is relatively inexpensive to make and is easy to clean and otherwise maintain.

Other objects of this invention will become apparent from time to time throughout the specification and claims as hereinafter related.

These and other objects of the invention are accomplished by a shoulder strap pad which is superior to prior pads or coverings because it takes advantage of the anatomical and biomechanical characteristics of the user's shoulder to provide anatomically correct support for carrying straps. This strap pad fits the shape of the shoulder, effectively raising the shoulder's profile so that there is no slope down which the strap may slide. This is accomplished by shaping the cushioning pad into a wedge or triangular shape. The strap is carried on top of this wedge and pushes down but cannot slide out. Prior pads and cushions have limited themselves to increasing the friction between strap and shoulder (or garment thereon). This frictional approach may also be used in combination with the instant invention to further prevent slipping. By making the wedge out of a cushion (whether of resilient synthetic or natural foam or of a filled cushion-like material), the carrying burden is further reduced. The wedge is positioned below the strap and increases the slope of the shoulder to level or to a slight incline. The pad may be bare, or it may be covered by leather, textile, or other fabric to make it more comely or to assist in attaching it to a strap. It may be formed separately as an attachment to any strap with suitable means for attachment, including but not limited to Velcro-like hook and loop fastening, adhesive, loops, or snaps. It may also be an integral part of such a carrying strap.

DESCRIPTION OF THE PREFERRED EMBODIMENT

Figure 1:
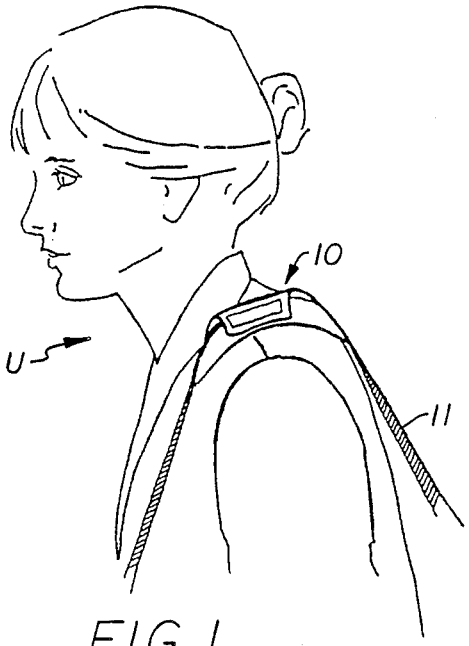
FIG. 1 is a side view of a user with the wedge-shaped strap pad on the shoulder, with a strap on top of the pad.

Referring the drawings by numerals of reference, and more particularly to FIG. 1, there is shown a preferred embodiment of this invention comprising a strap pad 10 worn by a user U while standing upright. Pad 10 is positioned on top of one of the user's shoulders and supports a shoulder strap 11 for any object carried by a shoulder strap.

Figure 2:
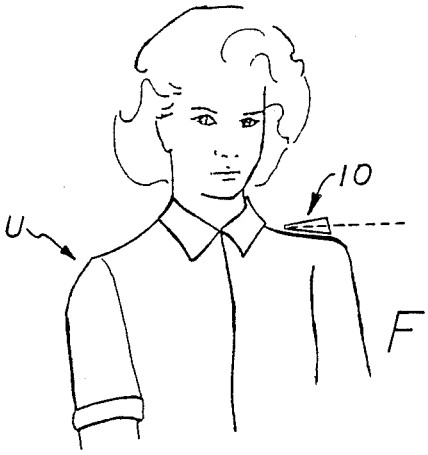
FIG. 2 is a front view of a user showing the wedge-shaped strap pad, on the shoulder.

The strap pad provides full anatomically correct support by building up the shoulder of the user to level or higher such that the shoulder with strap pad on it is higher than the inner portion of the shoulder. In FIG. 2, the pad is shown to be wedge-shaped. Thus a downward slope toward the neck is formed. Unlike a simple block of foam, pad 10 holds its structure, thereby preventing slipping of the strap. Yet when constructed of foam or some similarly resilient material, it cushions the weight of the strap.

The pad 10 comprises a pad insert or cushion 12 constructed from a single piece of solid or foamed rubber or plastic material enclosed in a fabric, leather, or other material cover 13 which is soft to the touch and which increases friction. Cover 13 is preferably removable for washing or cleaning purposes.

The pad 10 may also exist in the form of a flexible pouch or cover 13 stuffed with particulate material, filaments, or pieces of foam rubber defining the desired wedge shape. Also, the wedge may exist incorporated in a strap made of foam rubber, plastic, leather, or a filled triangular tubing.

Figure 7:
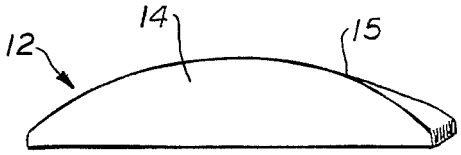
FIG. 7 is a front edge view or elevation of the strap pad without the cover.
Figure 8:
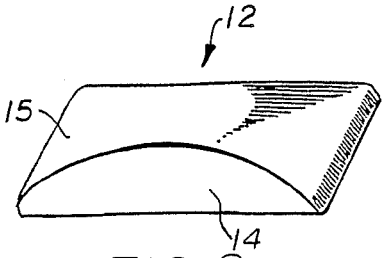
FIG. 8 is an upper front isometric view of the strap pad shown in FIG. 7 without the cover.
Figure 9:
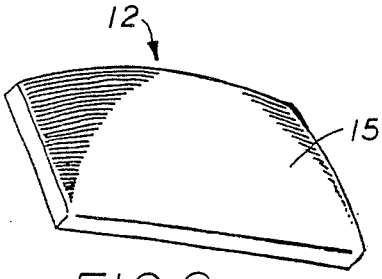
FIG. 9 is an upper rear isometric view of the strap pad shown in FIG. 7 without the cover.

In FIGS. 7, 8 and 9, pad insert 12 is shown in some detail. Pad insert 12 is wedge shaped with a flat side wall 14 and a curved top wall 15 which tapers downward to a rear edge 16. Curved top wall 15 reduces the height of the pad on the sides and improves the distribution of weight on the shoulder. The desired form of the pad is any wedge between 1 and 89 degrees. While the preferred embodiment is formed of a closed cell foam wedge of 30°, increasing or decreasing the resiliency of the material can greatly vary the possible embodiments. The length of the pad should range between 1 and 10 inches with the preferred embodiment 6 inches in length.

In FIGS. 3–6, the pad 10 is shown in different stages of assembly. Cover 13 is constructed to fit the wedge shaped insert 12 tightly or to maintain a wedge shape is filled with small pieces of foam rubber or plastic. Cover 13 has a main pocket portion 17 with a closing flap 18. Pocket portion 17 has one part 19 and flap 18 has the mating part 20 of a suitable fastening means. The fastening means shown is a multiple hook type fastener known as VEL-CRO. Other suitable fasteners, e.g. hook and eye, snap, zipper, etc., may be used.

Figure 3:
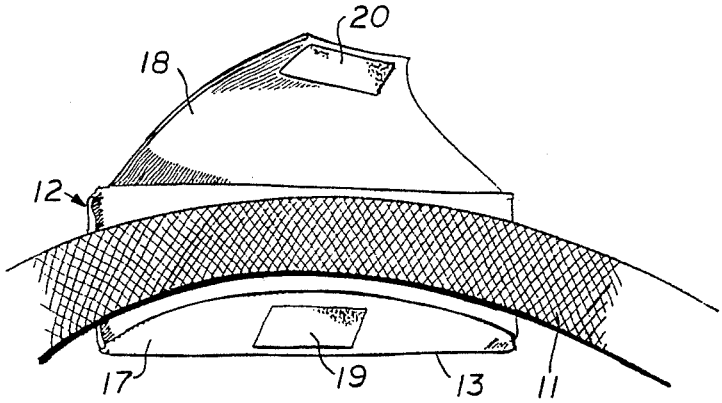
FIG. 3 is an isometric view on a larger scale showing the strap pad with the cover open and the strap being inserted.
Figure 4:
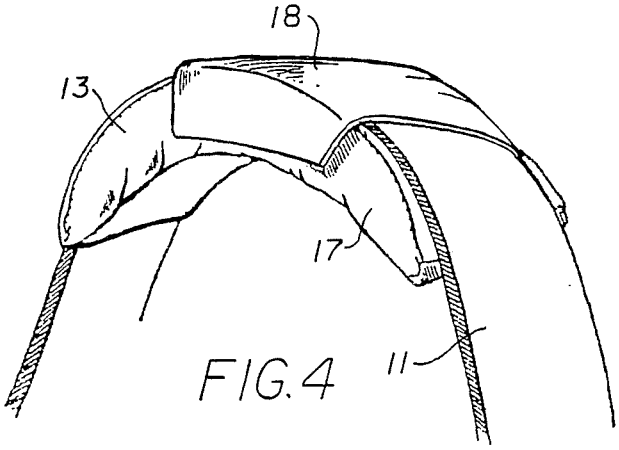
FIG. 4 is an isometric view on a larger scale showing the strap pad with the cover closed and the strap inserted in place.
Figure 5:
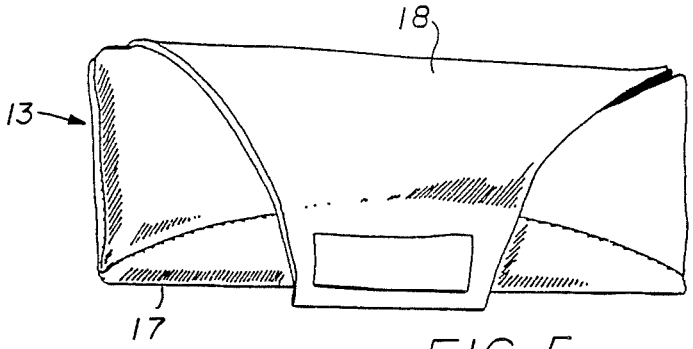
FIG. 5 is a plan view of the strap pad with the cover closed.
Figure 6:
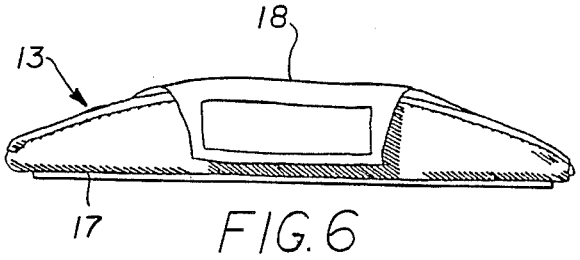
FIG. 6 is a front edge view or elevation of the strap pad with the cover closed.

In FIG. 3, the cover 13 is open and strap 11 is laid across the wedge-shaped pad. In FIG. 4, over 13 is closed and the strap 11 is retained in place. FIGS. 5 and 6 show plan and elevational views of the pad with cover 13 closed to retain the insert 12 (or other filling) in place in a wedge form.

OPERATION

The operation and function of this invention should be apparent from the foregoing description but the manner of use and advantages will be restated here for clarity.

Briefly, the strap pad 10 of this invention is superior to prior pads or coverings because it takes advantage of the anatomical and biomechanical characteristics of the user's shoulder to provide anatomically correct support for carrying straps. That is, this strap pad 10 fits the shape of the shoulder, effectively raising the shoulder's profile so that there is no slope down which the strap may slide. This is accomplished by shaping the cushioning pad 12 into a wedge or triangular shape. The strap 11, being carried on top of this wedge now pushes down but cannot slide out. Prior pads and cushions have limited themselves to increasing the friction between strap and shoulder (or garment thereon). This frictional approach may also be used in combination with the instant invention to further prevent slipping.

By making the wedge 12 out of a cushion (whether of resilient synthetic or natural foam or of a filled cushion-like material), the carrying burden is further reduced. The wedge 12 increases the slope of the shoulder to level or to a slight incline. To do this, the wedge 12 must be positioned below the strap. This also helps reduce its visibility, making it less cumbersome, more compact, and more comely.

The pad 10 can be constructed as a solid, stuffed, or inflatable structure which is moderately stiff so as to retain its wedge-shaped structure, yet be resilient enough to conform to the user's anatomy and the strap. Indeed, the wedge's conformance with the shoulder increases the friction and further prevents slipping, almost gripping the shoulder.

The pad may be bare, or it may be covered by leather, textile, or other fabric to make it more comely or to assist in attaching it to a strap. It may be formed separately as an attachment to any strap with suitable means for attachment, including but not limited to Velcro-like hook and loop fastening, adhesive, loops, or snaps. It may also be an integral part of such a carrying strap. The strap itself may even be formed in a triangular cross section to accomplish the same results. Thus it may be permanently affixed in one position relative to such a strap or it may be fashioned so as to be able to slide over the strap continuously, or as allowed by suitable fastening means.

It will be seen from the foregoing, then, that the pad 10 provides support for a carrying strap 11 while preventing it from slipping off an individual's shoulder. The pad provides this structurally, and, at times, frictionally. The pad is lightweight, comely, and unobtrusive, being situated beneath the strap being carried. It cushions the weight of the carrying strap. Therefore it should prove to be a very handy travelling companion, particularly for those required to carry burdens, such as luggage, cameras, or backpacks.

It will thus be seen that the objects set forth above, among those made apparent from the preceding description, are efficiently attained, and, since certain changes may be made in the above methods and in the above constructions without departing from the scope of the invention, it is intended that all matter contained in the above description or shown in the accompanying drawings be interpreted as illustrative and not in a limiting sense.

While this invention has been described fully and completely with reference to a single preferred embodiment, it should be understood that within the scope of the appended claims the invention may be practiced otherwise than as specifically described above.

We claim:

1. A shoulder strap assembly for carrying objects comprising a strap for attachment to the object to be carried and having a portion adapted to be positioned over the shoulder and external to the clothing of the user, pad means on the underside of said strap for preventing the strap from slipping off the shoulder of the user and comprising a resiliently padded portion of wedge shape positioned at and immediately underlying the portion of the strap to be worn over the shoulder and external to the clothing of the user, said wedge shape padded portion being such that the thick edge of the wedge is worn to the outside and the thin edge of the wedge to the inside relative to the shoulder of the wearer, said wedge-shaped padded portion being of foam rubber or plastic and substantially the same width as said strap, and the height of said wedge being such as to increase the plane of the user's shoulder to a plane level with the ground or inclined from neck to shoulder.

2. A shoulder strap assembly according to claim 1 in which said wedge-shaped padded portion is of foam rubber or plastic and substantially the same width as said strap.

3. A shoulder strap assembly according to claim 1 in which said wedge-shaped padded portion is curved downward on either side to distribute the forces of the strap more uniformly.

4. A shoulder strap assembly according to claim 1 in which said wedge-shaped padded portion is integral with the underside of said strap.

5. A shoulder strap assembly according to claim 1 in which said wedge-shaped padded portion is a separate pad removable from the strap.

6. A shoulder strap assembly according to claim 1 in which said wedge-shaped padded portion is a separate pad substantially the same width as said strap and removable from the strap and comprises a wedge-shaped pad of foam rubber or plastic secured on the strap.

7. A shoulder strap assembly according to claim 1 in which said wedge-shaped padded portion is a separate pad removable from the strap and encased in a cover secured on the strap.

8. A shoulder strap assembly according to claim 1 in which said wedge-shaped padded portion is a separate pad removable from the strap and encased in a cover secured on the strap, said cover being of a fabric or flexible sheet material having a wedge shaped pocket portion with a closing flap securing said wedge-shaped member therein.

9. A shoulder strap assembly according to claim 8 in which said cover having fastening means on the outside of said wedge shaped pocket portion and on the inside of said closing flap to secure said wedge-shaped pad therein.

10. A shoulder strap assembly according to claim 8 in which said cover having VEL-CRO hook fasteners on the outside of said wedge shaped pocket portion and on the inside of said closing flap to secure said wedge-shaped pad therein.

11. A shoulder strap assembly according to claim 3 in which said cover encloses said strap on top of said wedge shaped pad and is secured thereon by said closing flap.

12. A removable pad for attachment to a strap for supporting an object to be carried said strap having a portion adapted to be positioned over the shoulder and outside the clothing of the user, said pad being of wedge shape, of foam rubber or plastic, and substantially the same width as said strap and adapted to be positioned at the portion of the strap to be worn over the shoulder and outside the clothing of the user, said wedge shape being such that the thick edge of the wedge is worn to the outside and the thin edge of the wedge to the inside relative to the shoulder of the wearer, and means for securing said wedge shaped pad on the underside of the strap on which it is to be worn.

13. A removable pad for a shoulder strap according to claim 12 in which said wedge-shaped pad is of foam rubber or plastic.

14. A removable pad for a shoulder strap according to claim 12 in which said wedge-shaped pad is curved downward on either side to distribute the forces of the strap more uniformly.

15. A removable pad for a shoulder strap according to claim 12 in which said wedge-shaped pad is removable from the strap and encased in a cover adapted to be secured on the strap, said cover being of a fabric or flexible sheet material having a wedge shaped pocket portion with a closing flap securing said wedge-shaped member therein.

16. A removable pad for a shoulder strap according to claim 12 in which said cover having fastening means on the outside of said wedge shaped pocket portion and on the inside of said closing flap to secure said wedge-shaped member therein.

17. A removable pad for a shoulder strap according to claim 15 in which said cover having VEL-CRO hook fasteners on the outside of said wedge shaped pocket portion and on the inside of said closing flap to securing said wedge-shaped member therein.

18. A removable pad for a shoulder strap according to claim 15 in which said cover is adapted to enclose said strap when positioned on top of said wedge shaped member and secures said strap thereon by said closing flap.

* * * * *